United States Patent [19]

Shaffer

[11] Patent Number: 4,774,113

[45] Date of Patent: Sep. 27, 1988

[54] ARTIFICIAL TREE LIMB

[75] Inventor: Earl R. Shaffer, Muncy, Pa.

[73] Assignee: Herman Rynveld's Son corporation, New Albany, Pa.

[21] Appl. No.: 118,480

[22] Filed: Nov. 9, 1987

[51] Int. Cl.[4] ..... A47G 33/06

[52] U.S. Cl. ..... 428/18; 156/61; 211/205

[58] Field of Search ..... 428/17, 18, 19, 20; 156/61; 211/196, 205

[56] References Cited

U.S. PATENT DOCUMENTS

| | | | |
|---|---|---|---|
| 1,829,687 | 10/1931 | Takiguchi | 428/18 |
| 3,594,260 | 7/1971 | Dieffenbach | 428/20 |
| 3,819,457 | 6/1974 | Mottel | 428/9 |
| 3,834,976 | 9/1974 | Mottel | 428/18 |
| 4,305,980 | 12/1981 | Spiegel et al. | 428/20 X |
| 4,590,105 | 5/1986 | Shaffer | 428/20 X |

*Primary Examiner*—Henry F. Epstein

[57] ABSTRACT

Artificial tree limb, and the finished tree from an assemblage of such limbs, each limb including twigs comprising a twisted pair of wires entrapping fire-retardant filaments to simulate needles, the plurality of twigs being affixed to a heavier wire or wires by wrapping the base of the twigs to the heavier wire to form a branch, and a plurality of branches twisted together at the base thereof, or attached to a heavier wire, all having wrappings at the point of attachment, to form a limb, and a plurality of limbs attached to a vertical trunk or wrapped together at the base of each limb to form a tree.

6 Claims, 1 Drawing Sheet

ARTIFICIAL TREE LIMB

BACKGROUND OF THE INVENTION

The invention relates to artificial trees, preferably in the nature of pine trees. Such trees will display fire-retardant filaments simulating pine needles, usually made of a fire-retardant, synthetic resin in the nature of polyvinyl chloride. While such artificial limbs and trees will normally be green in order to simulate pine limbs and pine trees, it will be appreciated that other fire-retardant filaments can be used, such as metal foil slivers or silver-coated synthetic resins in order that the finished limb or tree will present a silver color. Other colors can be used.

The goal of artificial tree manufacture is the achievement of a natural lifelike appearance. U.S. Pat. No. 4,590,105—Shaffer discloses a more natural appearing "limb" than had been possible, and it is contemplated that the present invention will utilize the teachings of U.S. Pat. No. 4,590,105. Additional patents that confront the problem of manufacture of natural-looking artificial branches and trees are U.S. Pat. No. 3,834,976—Mottel, U.S. Pat. No. 3,819,457—Mottel, and U.S. Pat. No. 4,305,980—Spiegel.

The terminology chosen to describe the invention is for convenience in this description. Twigs are combined to form a branch, branches are combined to form a limb, and limbs are combined to form a tree. While similar terminology may occur in prior patents in the artificial tree art, such terminology does not necessarily identify the same elements as described herein.

SUMMARY OF THE INVENTION

The invention contemplates forming a plurality of twigs by twisting a pair of wires and wrapping fire-retardant filaments material therebetween in order to form a plurality of twigs. The twigs may then be twisted together at the base thereof, or attached to a heavier single wire or heavier pair of twisted wires. The points of attachment of the twigs either to each other or to the heavier wire or wires will be wrapped to simulate the appearance of the thickened point of attachment of a twig to a branch. Such wrappings will normally be a brown-colored, black, dark green, or other colored material to simulate the body of a branch. Most conveniently the wrappings will be in the form of a plastic strip of fire-retardant polyvinyl chloride or other suitable plastic materials. The wrappings preferably will be applied even to the regions of heavier wire between the points of attachment of the twigs to that heavier wire. The wrappings should be applied preferably along the entire length of the branch in order to conceal the fact that wires are the supporting members.

Two or more branches are then either twisted together or attached to still heavier wire to form a limb. Again, the points of attachment of the branches to the heavier wires or to each other shall be wrapped with a colored fire-retardant resinous strip in order to simulate the thickened portion of a limb where branches branch out to produce a multiple limb. Again, preferably, all parts of the wire-supporting members of the limb will be wrapped with a colored material to simulate the actual limb of a tree. Additional realism will be achieved by attaching a plurality of additional twigs in appropriate portions of the limb in order to fill out the appearance of the limb as seen by a critical eye.

To form a small tree, a plurality of limbs are either twisted together or joined to a heavier supporting wire with dark-colored wrappings again being used at the points of junction. Alternatively, a plurality of limbs may be inserted into appropriate holes in an upright wood, plastic, or metal simulated tree trunk, smaller branches being assembled at the top and larger branches being used toward the bottom.

DETAILED DESCRIPTION OF PREFERRED EMBODIMENTS

Figure 1:
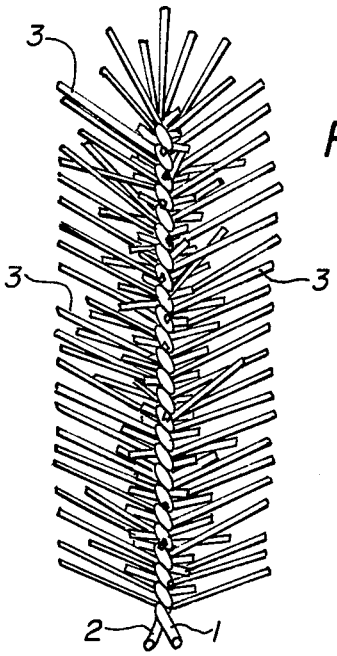
FIG. 1 shows a twig made of twisted wires trapping fire-retardant filaments.
Figure 2:
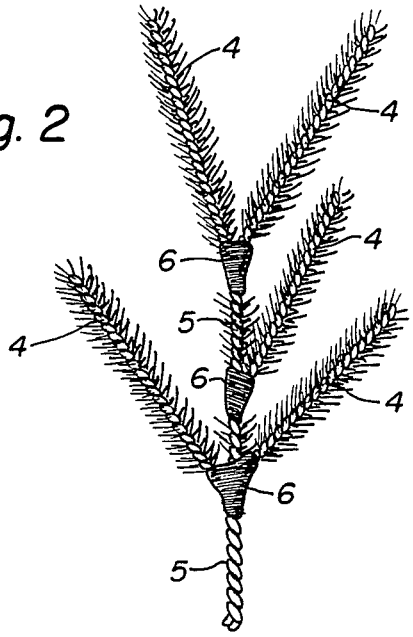
FIG. 2 shows a plurality of twigs assembled to form a branch.

Referring to FIG. 1, wires 1 and 2 are twisted together to entrap the fire-retardant filaments 3 to form the finished twig. In FIG. 2, the twigs 4 are attached to a pair of twisted wires 5, with wrappings 6 at the points of attachment. In FIG. 2, the pair of twisted wires 5 are not shown covered with additional wrappings in order to illustrate how the twisted wires 5 serve as supporting members for the twigs 4.

Figure 3:
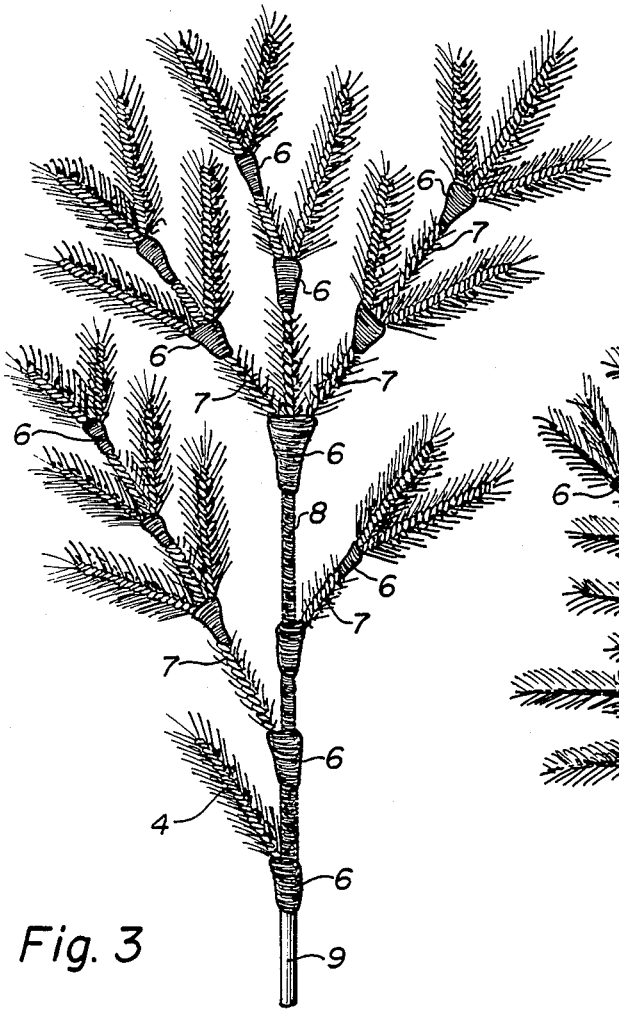
FIG. 3 shows a plurality of branches assembled to form a limb.

In FIG. 3, a plurality of branches 7 are assembled on heavy supporting wires 8 which, in this FIG. 3 are shown as having additional wrappings to conceal the supporting wires of the finished limb. The wrappings 6 complete the limb. The base of the limb 9 is adopted either to be twisted with additional limbs to form a small tree or to be inserted into a supporting artificial tree trunk, not shown.

Figure 4:
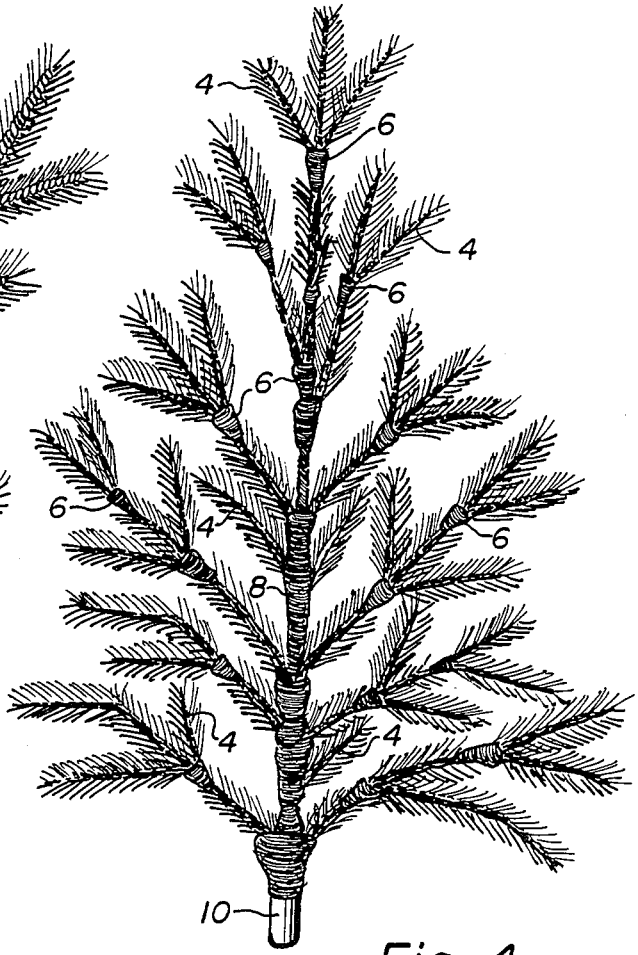
FIG. 4 shows a plurality of limbs assembled to form a tree.

FIG. 4 shows a completed artificial tree made of an assemblage of limbs. Additional twigs 4 are shown attached at various places to the main trunk 10 or to wherever on a branch or limb an improvement in the natural appearance of the tree will result. The wrappings 6 will occur throughout the finished tree and the main trunk will normally also be covered with the wrappings 6.

What I claim is:

1. A decorative tree limb comprising in combination:

(a) a plurality of twigs, each twig comprising twisted pairs of wires having fire-retardant filaments therebetween, (b) a plurality of branches, each branch comprising a plurality of twigs twisted together with or without a supporting wire, (c) at least two branches joined together to form a limb, and (d) a plurality of fire-retardant wrappings encasing the points of attachment of the twigs and branches.

2. An artificial tree comprising a plurality of the limbs of claim 1.

3. A limb according to claim 1 wherein said wrappings comprise a dark-brown, fire-retardant, flexible, resinous strip.

4. A limb according to claim 1 having additional twigs attached thereto.

5. A limb according to claim 1 in which said branch is formed from a pair of twisted wires holding ends of twigs therebetween.

6. A limb according to claim 1 in which said branches are formed by twisting the ends of said twigs together.

* * * * *